US010391554B2

(12) United States Patent
Piascik et al.

(10) Patent No.: US 10,391,554 B2
(45) Date of Patent: Aug. 27, 2019

(54) POWDER MIXTURES CONTAINING UNIFORM DISPERSIONS OF CERAMIC PARTICLES IN SUPERALLOY PARTICLES AND RELATED METHODS

(71) Applicant: HONEYWELL INTERNATIONAL INC., Morris Plains, NJ (US)

(72) Inventors: James Piascik, Randolph, NJ (US); Amer Aizaz, Phoenix, AZ (US); James J Cobb, Casa Grande, AZ (US); James S Roundy, Gilbert, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 291 days.

(21) Appl. No.: 15/402,442

(22) Filed: Jan. 10, 2017

(65) Prior Publication Data

US 2017/0113271 A1 Apr. 27, 2017

Related U.S. Application Data

(62) Division of application No. 14/036,373, filed on Sep. 25, 2013, now Pat. No. 9,573,192.

(51) Int. Cl.
*C22C 32/00* (2006.01)
*B22F 1/00* (2006.01)
(Continued)

(52) U.S. Cl.
CPC ..... *B22F 1/0003* (2013.01); *B22F 5/009* (2013.01); *B22F 5/04* (2013.01); *B22F 9/04* (2013.01);
(Continued)

(58) Field of Classification Search
None
See application file for complete search history.

(56) References Cited

U.S. PATENT DOCUMENTS 3,985,582 A * 10/1976 Bibring ..... C30B 21/02 148/538
4,156,053 A 5/1979 Baranow
(Continued)

FOREIGN PATENT DOCUMENTS

EP 1548134 A2 6/2005
EP 1643007 A1 4/2006
(Continued)

OTHER PUBLICATIONS

Yamanoglu, R. et al.: "Microstructural investigation of as cast and PREP atomised Ti—6Al—4V alloy" Powder Metallurgy, vol. 54, No. 5, pp. 604-607(4), Maney Publishing, Dec. 2011.
(Continued)

*Primary Examiner* — George Wyszomierski
(74) *Attorney, Agent, or Firm* — Lorenz & Kopf, LLP

(57) ABSTRACT

Embodiments of a method for producing powder mixtures having uniform dispersion of ceramic particles within larger superalloy particles are provided, as are embodiments of superalloy powder mixtures. In one embodiment, the method includes producing an initial powder mixture comprising ceramic particles mixed with superalloy mother particles having an average diameter larger than the average diameter of the ceramic particles. The initial powder mixture is formed into a consumable solid body. At least a portion of the consumable solid body is gradually melted, while the consumable solid body is rotated at a rate of speed sufficient to cast-off a uniformly dispersed powder mixture in which the ceramic particles are embedded within the superalloy mother particles.

18 Claims, 3 Drawing Sheets

(51) Int. Cl.

| | |
|---|---|
| ***C22C 1/04*** | (2006.01) |
| ***C22C 1/10*** | (2006.01) |
| ***B22F 5/04*** | (2006.01) |
| ***B22F 9/10*** | (2006.01) |
| ***B22F 9/04*** | (2006.01) |
| ***B22F 5/00*** | (2006.01) |
| *B22F 1/02* | (2006.01) |

(52) U.S. Cl.

CPC ..... *B22F 9/10* (2013.01); *C22C 1/0433* (2013.01); *C22C 1/1084* (2013.01); *C22C 32/00* (2013.01); *C22C 32/001* (2013.01); *C22C 32/0005* (2013.01); *C22C 32/0052* (2013.01); *B22F 1/0059* (2013.01); *B22F 1/02* (2013.01); *B22F 2202/01* (2013.01); *B22F 2301/15* (2013.01); *B22F 2302/10* (2013.01); *B22F 2302/20* (2013.01); *B22F 2302/25* (2013.01); *B22F 2302/253* (2013.01); *B22F 2304/05* (2013.01); *B22F 2304/054* (2013.01); *B22F 2304/056* (2013.01); *B22F 2304/058* (2013.01); *B22F 2304/10* (2013.01); *B22F 2998/10* (2013.01); *B22F 2999/00* (2013.01)

(56) References Cited

U.S. PATENT DOCUMENTS

| | | | | |
|---|---|---|---|---|
| 4,275,124 | A * | 6/1981 | McComas | C23C 4/073 427/450 |
| 5,079,100 | A * | 1/1992 | Descamp | C25D 13/02 175/65 |
| 5,855,642 | A | 1/1999 | Miller et al. | |
| 2007/0151639 | A1 | 7/2007 | Oruganti et al. | |
| 2009/0283331 | A1 * | 11/2009 | Heath | B22F 3/115 175/325.2 |
| 2010/0009089 | A1 * | 1/2010 | Junod | C22C 1/0433 427/446 |
| 2011/0103961 | A1 | 5/2011 | Glover et al. | |
| 2012/0260581 | A1 | 10/2012 | Pearce et al. | |
| 2013/0058825 | A1 | 3/2013 | Fukae et al. | |

FOREIGN PATENT DOCUMENTS

| | | | |
|---|---|---|---|
| EP | 1952915 | A1 | 8/2008 |
| GB | 1452660 | A | 10/1976 |
| JP | 58100602 | A | 6/1983 |
| JP | 2005298855 | A | 10/2005 |
| WO | 9905332 | A1 | 2/1999 |

OTHER PUBLICATIONS

Extended EP search report for Application No. 14184162.7 dated Nov. 10, 2015.

Extended EP Search Report for Application No. 14 184 162.7-1373 dated Sep. 29, 2017.

* cited by examiner

POWDER MIXTURES CONTAINING UNIFORM DISPERSIONS OF CERAMIC PARTICLES IN SUPERALLOY PARTICLES AND RELATED METHODS

CROSS-REFERENCE TO RELATED APPLICATION

This application is a divisional of U.S. patent application Ser. No. 14/036,373, filed Sep. 25, 2013, now U.S. Pat. No. 9,573,192.

TECHNICAL FIELD

The present invention relates generally to powder metallurgy and, more particularly, to powder mixtures and methods for preparing powder mixtures, which contain ceramic particles uniformly dispersed within superalloy particles and which are well-suited for producing articles having improved performance characteristics under high temperature operating conditions.

BACKGROUND

High temperature components (that is, components exposed to temperature exceeding about 1000° F. or about 540° C. during operation) are commonly fabricated by powder metallurgy and, specifically, by sintering superalloy powders to produce a solid body, which may then undergo further processing to produce the finished component. Components produced from sintered superalloy powders may have thermal tolerances greatly exceeding those of other metals and alloys. However, components produced by sintering conventionally-known superalloy powders may still have hardness, fatigue resistance, and wear resistance properties that are undesirably limited in certain applications, such as when such powders are used to produce the rings of a rolling element bearing deployed within a high temperature operating environment. While high temperature ceramic materials can be utilized to produce articles having improved hardness and wear resistance under elevated operating temperatures, the toughness and ductility of high temperature ceramic materials tend to be relatively poor. Consequently, such ceramic materials may be undesirably brittle and fracture prone when utilized to produce high temperature bearing rings or other components subject to severe loading conditions during high temperature operation. Furthermore, additional design modifications to the high temperature components may be required if fabricated from relatively brittle ceramic materials.

It would thus be desirable to provide embodiments of a method for producing enhanced superalloy powders or powder mixtures that, when sintered and otherwise processed, yield high temperature articles having excellent hardness and wear resistant properties, while also having relatively high ductility and fracture resistance. It would also be desirable if, in at least some embodiments, the method could further be utilized to prepare enhanced superalloy powder mixtures able to produce high temperature articles having other improved characteristics as compared to articles produced from other, conventionally-known superalloy powders. For example, it would be desirable if embodiments of the method could produce an enhanced superalloy powder mixture having increased strength under high temperature operating conditions when sintered into a chosen article, such as a turbine blade, vane, nozzle, duct, or other high temperature component deployed within a gas turbine engine. Other desirable features and characteristics of embodiments of the present invention will become apparent from the subsequent Detailed Description and the appended Claims, taken in conjunction with the accompanying drawings and the foregoing Background.

BRIEF SUMMARY

Embodiments of a method for producing powder mixtures having uniform dispersion of ceramic particles within superalloy particles are provided. In one embodiment, the method includes producing an initial powder mixture comprising ceramic particles mixed with superalloy mother particles having an average diameter larger than the average diameter of the ceramic particles. The initial powder mixture is preferably prepared utilizing a resonant acoustic mixing process, a milling process, or other process capable of producing a powder mixture wherein the ceramic particles are substantially uniformly or evenly dispersed throughout the powder mixture. The initial powder mixture is formed into a consumable solid body. At least a portion of the consumable solid body is gradually melted, while the consumable solid body is rotated at a rate of speed sufficient to cast-off a uniformly dispersed powder mixture in which the ceramic particles are embedded within the superalloy mother particles.

In another embodiment, the method is carried-out utilizing a consumable solid body composed of ceramic particles mixed with superalloy mother particles having an average diameter larger than the average diameter of the ceramic particles. Similar to the embodiment above, the method includes the process or step of gradually melting at least a portion of the consumable solid body, while rotating the consumable solid body at a rate of speed sufficient to cast-off a uniformly dispersed powder mixture in which the ceramic particles are embedded within the superalloy mother particles.

Embodiments of a superalloy powder mixture are also provided. In one embodiment, the superalloy powder mixture include a superalloy powder comprising a plurality of superalloy mother particles. Ceramic particles are distributed throughout the superalloy powder and having an average diameter less than (e.g., at least 100 times less than) that of the superalloy mother particles. At least a majority of the ceramic particles may be embedded within the superalloy mother particles. Additionally, the superalloy powder mixture may consist essentially of at least 85% superalloy powder, by weight, with the remainder particulate ceramic materials in further embodiments.

BRIEF DESCRIPTION OF THE DRAWINGS

At least one example of the present invention will hereinafter be described in conjunction with the following figures, wherein like numerals denote like elements, and.

DETAILED DESCRIPTION

Figure 1:
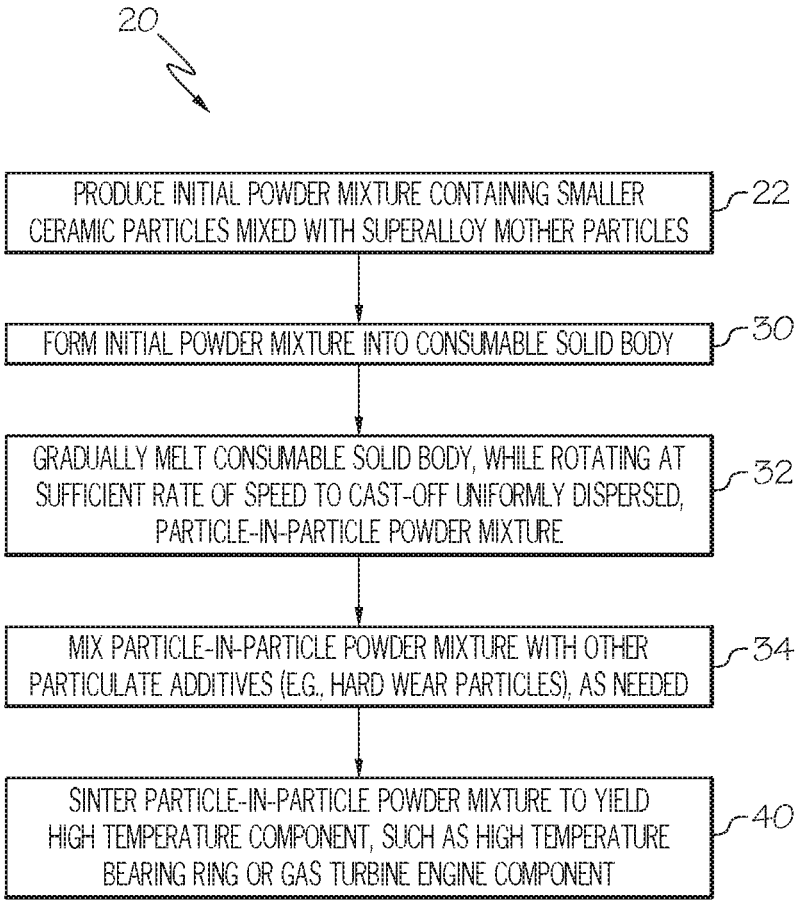
FIG. 1 is a flow chart setting-forth an exemplary embodiment of a method for preparing a uniformly dispersed, particle-infiltrated powder mixture, as illustrated in accordance with an exemplary embodiment of the present invention.

The following Detailed Description is merely exemplary in nature and is not intended to limit the invention or the application and uses of the invention. Furthermore, there is no intention to be bound by any theory presented in the preceding Background or the following Detailed Description.

As appearing herein, the term "superalloy" is utilized to denote a material containing two or more metals and having an operative thermal tolerance exceeding about 1000° F. or about 540° C. As further appearing herein, the term "nanoparticle" refers a particle having a diameter or other cross-sectional dimension greater than 0.1 nanometer (nm) and less than 1 micron (μm). The term "ceramic" is utilized to refer to an inorganic, non-metallic material, whether amorphous or crystalline, such as an oxide or non-oxide of the type described below. Finally, the descriptor "uniformly dispersed" is utilized in a relative sense to refer to a powder mixture containing superalloy mother particles in which ceramic particles (e.g., ceramic nanoparticles) have been embedded wherein, due to the infiltration of the ceramic particles into the mother particles, the distribution of the ceramic particles throughout the powder mixture is made more uniform or homogenous than would otherwise be the case if the ceramic particles were not embedded into the mother particles: that is, if the below-described dispersion or particle infiltration process were not performed (see, for example, the description set-forth below in conjunction with STEP 34 of exemplary method 20 shown in FIG. 1).

As described in the foregoing section entitled "BACKGROUND," there exists an ongoing need for enhanced superalloy powder or powder mixtures suitable for usage in the production of articles or components having enhanced performance characteristics under high temperature (e.g., >~1000° F. or >~540° C.) conditions as compared to components fabricated from other known high temperature materials, such as conventionally-known superalloy powders and ceramic materials. Such enhanced performance characteristics may include, but are not necessarily limited to, improved hardness, fatigue resistance, wear resistance, toughness (fracture resistance), ductility, and/or strength properties under high temperature operating conditions. The enhanced superalloy powder mixtures described herein are consequently well-suited for producing high temperature articles wherein such properties are of particular value. For example, in embodiments wherein the powder mixture is formulated to provide improved hot hardness, fatigue resistance, wear resistance, and toughness, the powder mixture may be particularly well-suited for use in the production of high temperature bearing rings or bushings. As a second example, in embodiments wherein the enhanced superalloy powder mixture is formulated to provide increased strength over an expanded temperature range as compared conventional superalloy powders, the powder mixture may be advantageously employed to produce gas turbine engine components exposed to combustive gas flow during engine operation, such as turbine blades, vanes, ducts, nozzles, and the like.

Embodiments of the enhanced superalloy powder are preferably produced from an initial powder mixture containing one or more pre-existing superalloy powders mixed with one or more types of ceramic particles. It is preferred that the ceramic particles have an average diameter in the nanometer range (the nanometer range between 1 nm and 1 μm, and the preferred ceramic particle sizes falling within this range set-forth below); however, in certain embodiments, the ceramic particles may have an average diameter in the low micron range and, specifically, between 1 μm and 5 μm. In any event, the ceramic particles will have average diameters less than the metallic particles of which the superalloy powder is composed. For this reason, the ceramic particles may be referred to as the "smaller ceramic particles" herein, while the particles of the superalloy powders may be referred to as the "larger superalloy particles" or as "superalloy mother particles." Additionally, in preferred embodiments wherein the average diameter of the ceramic particles falls within the nanometer range, the ceramic particles may be referred to herein as "ceramic nanoparticles."

As will be described in detail below, the initial mixture of the pre-existing superalloy powder and the smaller ceramic particles are processed in a manner whereby the ceramic particles are uniformly dispersed throughout the final powder mixture. Notably, by virtue of the below described dispersion process, the ceramic particles become largely or wholly embedded within the larger metallic particles of the superalloy powder. The end result is uniformly dispersed, particle-infiltrated powder mixture, which may be utilized to produce articles having superior hot hardness, fatigue resistance, wear resistance, toughness (fracture resistance), ductility, and/or strength properties under highly elevated temperatures. The enhanced powder mixture produced pursuant the below-described fabrication process may consist essentially of ceramic particles, and preferably ceramic nanoparticles, dispersed throughout the larger superalloy particles; or, instead, may include other constituents (e.g., additional hard wear particles) in certain embodiments.

It is, of course, possible to simply utilize the initial powder mixture (that is, a mixture of a chosen superalloy powder and smaller ceramic particles) to produce high temperature articles by powder metallurgy. However, within the initial powder mixture, the smaller ceramic particles are largely concentrated at the boundaries of the larger superalloy particles or in the free space between the superalloy particles. As a result, the smaller ceramic particles may interfere with proper sintering of the superalloy particles and may themselves conglomerate during processing. Conglomeration of the ceramic particles results in larger particles, which can coarsen the microstructure of the high temperature article resulting in decreased ductility, increased brittleness, and a greater likelihood of fracture when subject to severe loading or vibratory conditions. Such a reduction in ductility may occur even in the absence of ceramic particle conglomeration due to the relatively non-homogenous distribution of the smaller ceramic particles throughout the powder mixture and, specifically, due to the relatively high concentrations of ceramic particles at the interfaces between the superalloy particles. In contrast, by infiltrating the superalloy mother particles with the smaller ceramic particles under process conditions minimizing conglomeration of the smaller ceramic particles, a powder mixture can be produced wherein the ceramic particles are more uniformly dispersed throughout the powder mixture to mitigate, if not wholly overcome, the foregoing limitations.

FIG. 1 is a flowchart setting-forth a method 20 for preparing a uniformly dispersed, particle-infiltrated powder mixture well-suited for usage in the production of high temperature articles. As shown in FIG. 1 and described in detail below, method 20 is offered by way of non-limiting example only. It is emphasized that the fabrication steps shown in FIG. 1 can be performed in alternative orders, that certain steps may be omitted, and that additional steps may be performed in alternative embodiments. Exemplary method 20 commences with the production of an initial powder mixture containing at least one type of superalloy mother particle mixed with at least one type of ceramic particle or nanoparticle (STEP 22, FIG. 1). The superalloy mother particles may be supplied in the form of a pre-existing superalloy powder, whether independently fabricated or purchased from a commercial supplier. Various different superalloy powders are commercially available that may be utilized including, for example, nickel-based superalloys, such as Inconel® 718 and CMSX®-10; and cobalt-based superalloys, such as HS-25; to list but a few examples. The particular superalloy or superalloys chosen for inclusion in the initial powder mixture will be application specific and are not limited in the context of the present invention.

A non-exhaustive list of ceramic particles that may be contained in the initial powder mixture includes oxides, such as alumina and zirconia; non-oxides, such as carbides, borides, nitrides, and silicides; and combinations thereof. In preferred embodiments, the initial powder mixture contains carbide and/or oxide particles or nanoparticles. The particular type or types of ceramic particles or nanoparticles combined with the pre-existing superalloy powder to yield the initial powder mixture will typically be chosen based upon the desired properties of the high temperature articles to be produced therefrom. In instances wherein the high temperature article is desirably imparted with superior hardness and wear resistance properties, while also having a relatively high toughness (fracture resistance) and ductility, it is preferred that carbide, nitride, and/or boride particles are included within initial powder mixture. Of the foregoing list, it may be especially preferably that carbide particles, such as tungsten carbide or titanium carbide particles, are contained within the initial powder mixture. By comparison, in instances wherein the high temperature article is desirably imparted with an increased strength, it is preferred that oxide (e.g., alumina or zirconia) particles are included within the initial powder mixture. In this latter case, the strength of the high temperature article may be increased under high temperature (e.g., >~1000° F. or >~540° C.) operating conditions as compared to simply producing the high temperature article from the superalloy powder itself.

The ratio of ceramic particles to superalloy mother particles contained within the powder mixture will vary amongst different embodiments in relation to the desired properties of the high temperature articles produced from the final (uniformly dispersed) powder mixture. Generally, it may be preferred that the initial powder mixture contains less than about 10%, by weight (wt %), of the ceramic particles. It has been found that, above this upper threshold, undesired conglomeration of the ceramic particles may occur during mixing. At the same time, in instances wherein a hard, wear resistant (e.g., a carbide, nitride, or boride) particle is included within the powder mixture, it will often be desirable to maximize the particle content or "fill rate" within the initial powder mixture without exceeding this upper threshold. Thus, in such cases, it generally may be preferred that the powder mixture contains between about 5 wt % and about 10 wt % of the ceramic particles. Conversely, in instances wherein an oxide particle or nanoparticle is included within the powder mixture for superalloy-strengthen purposes, the ceramic particle content of the initial powder mixture may be considerably lower; e.g., in one embodiment, the powder mixture may contain less than about 2 wt % and, preferably, between about 0.5 wt % and about 1.0 wt % of the oxide particles or nanoparticles. The foregoing examples notwithstanding, the initial powder mixture may contain greater or lesser amounts of ceramic particles of the aforementioned ranges (e.g., greater than 10 wt % ceramic particles) in further embodiments.

The respective shapes of the smaller ceramic particles and larger superalloy mother particles may vary, but are preferably both generally spherical. As indicated above, the superalloy mother particles are considerably larger than the ceramic particles. In preferred embodiments, the ceramic nanoparticles are used, which, by definition, have an average diameter less than 1 μm. In one embodiment, the average diameter of the superalloy mother particles is at least 100 times and may be over 500 times the average diameter of the smaller (e.g., nanometer or low micron range) ceramic particles included within the initial powder mixture. By way of example, the ceramic particles may have an average diameter less than about 5 μm; more preferably, between about 5 and about 500 nm; and, still more preferably, between about 10 and about 100 nm. By comparison, the superalloy mother particles preferably have an average diameter less than about 50 μm and, perhaps, between about 10 and about 50 μm. In certain embodiments, minimizing the size of the superalloy mother particle may advantageously allow the fill rate of the ceramic particles to be favorably increased while avoiding conglomeration of the ceramic particles during the below-described mixing process. In further embodiments, the superalloy and ceramic particle size may be greater than or less than the aforementioned ranges.

The initial powder mixture is ideally produced as a substantially uniform blend of the selected superalloy powder (or powders) and the smaller ceramic particles or nanoparticles. Different mixing techniques can be employed for producing such a substantially uniform powder blend including, but not limited to, ball milling and roll milling. In preferred implementations, a Resonant Acoustic Mixing ("RAM") process is employed. During such a RAM process, the powders may be loaded into the chamber of a resonant acoustic mixture. When activated, the RAM mixer rapidly oscillates the chamber and the powders contained therein over a selected displacement range and at a selected frequency. Advantageously, such a RAM process can produce a substantially uniform powder mixture in a relatively short period of time (e.g., on the order of minutes) relative to milling processes, which may require much longer mixing periods to produce a comparable mixture (e.g., on the order of days). In certain embodiments, such as when the initial powder mixture has a relatively high ceramic particle content (e.g., a fill rate approaching or exceeding 10 wt %), it may be desirable to place mixing media (e.g., zirconia balls) within the RAM chamber during mixing. Additionally or alternatively, it may be desirable to add a relatively small amount of water or another liquid to transform the powder mixture into a slurry during the mixing process to further decrease the likelihood of ceramic particle conglomeration.

Figure 2:
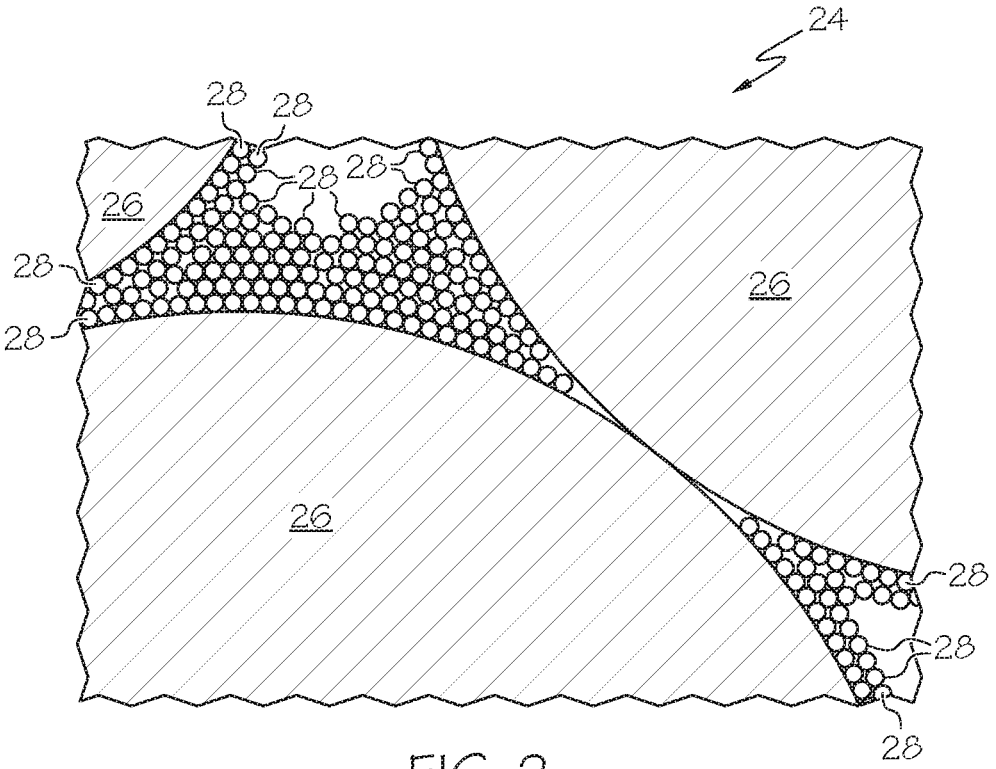
FIGS. 2 and 3 are cross-sectional view of a magnified region of an initial powder mixture and a consumable solid body, respectively, that may be utilized in the performance of the exemplary method illustrated in FIG. 1.

FIG. 2 is a cross-sectional view of a magnified portion of an initial powder mixture 24 that may be produced pursuant to STEP 22 of exemplary method 20 (FIG. 1), as illustrated in accordance with an exemplary embodiment of the present invention. While the field of view shown in FIG. 2 is relatively limited, it can be seen that powder mixture 24 includes a plurality of superalloy mother particles 26 mixed with a plurality of smaller ceramic particles 28. After the above-described mixing process, the smaller ceramic particles 28 may coat or envelope the outer surface of superalloy mother particles 26; however, relatively few, if any, particles 28 will have lodged or become embedded within the bodies of mother particles 26. Ceramic particles 28 may also partially fill the space between superalloy mother particles 26. While not drawn to a precise scale, FIG. 2 provides a general visual approximation of the relative difference in size between the smaller ceramic particles 28 and the larger superalloy mother particles 26 in an embodiment. In further embodiments, disparity in size between superalloy mother particles 26 and ceramic particles 28 may be greater than that generically illustrated in FIG. 2.

Continuing with exemplary method 20, the initial powder mixture (e.g., powder mixture 24 shown in FIG. 2) is now formed into a sacrificial or consumable solid body (STEP 30, FIG. 1). Conventional powder metallurgy techniques (e.g., sintering and/or hot isostatic pressing) may be employed to bond together the superalloy mother particles 26 and, therefore, yield a solid body or coherent mass containing the smaller ceramic particles 28 confined or trapped between the larger mother particles 26. In one embodiment, a hot isostatic pressing process is utilized at an elevated temperature below the melt point of the particles and under a sufficient pressure to create a metallurgical or diffusion bond between the particles. The resulting solid body may thus be composed of a metallic matrix, which is made-up of superalloy mother particles 26 and in which ceramic particles 28 are suspended. In one embodiment, the initial powder mixture is formed into an elongated cylinder or rod; however, the particular shape into which the initial powder mixture is formed may vary amongst embodiments. One or more organic binder materials may also be added to the initial powder mixture and removed before consolidating the power mixture into the consumable body during STEP 30 utilizing, for example, a furnace bake performed at an elevated temperature (e.g., between 260 and 540° C.) at which organic materials decompose or burn-away.

Next, at STEP 32 of exemplary method 20 (FIG. 1), a powder particle infiltration process is performed during which the smaller ceramic particles 28 are infiltrated into superalloy mother particles 26 to yield a uniformly dispersed, particle-infiltrated powder mixture. This may be accomplished utilizing a melt-and-spin process during which the consumable solid body is gradually melted, while rotated at a relatively high rate of speed (e.g., between 5,000 and 10,000 revolutions per minute) sufficient to cast-off the uniformly dispersed powder mixture. For example, in implementations wherein the consumable solid body is formed into an elongated rod, the tip of the rod may be gradually melted by application of a heat source, such as a laser or a plasma torch heat source. As a still more specific and non-limiting example, a Plasma Rotating Electrode Process (PREP) technique may be employed wherein the solid body serves as a rotating electrode, which is placed in proximity with a stationary (e.g., tungsten) electrode. An inert gas is introduced into the PREP chamber, and a plasma torch is created between the consumable solid body (the rotating electrode) and the stationary electrode to apply heat and create a melt zone within the solid body. As the consumable solid body is spun at a relatively high rate of speed (e.g., via attachment to a rotating spindle), the molten superalloy particles along and the ceramic particles are cast-off due to centrifugal with little to no ceramic particle conglomeration. The particles are collected and allowed to cool within the PREP chamber to yield a uniformly dispersed powder mixture wherein the ceramic particles have been thrust into the bodies of superalloy mother particles, while in a molten phase. The final particle size of the superalloy mother particles, now infiltrated with the ceramic particles, may be different (e.g., slightly smaller) than the original size of the superalloy particles contained within the initial powder mixture; e.g., in one embodiment, the average diameter of the particle-containing superalloy mother particles is less than about 40 μm and, perhaps, between about 5 and about 40 μm. The size of the ceramic particles will generally remain unchanged.

Figure 3:
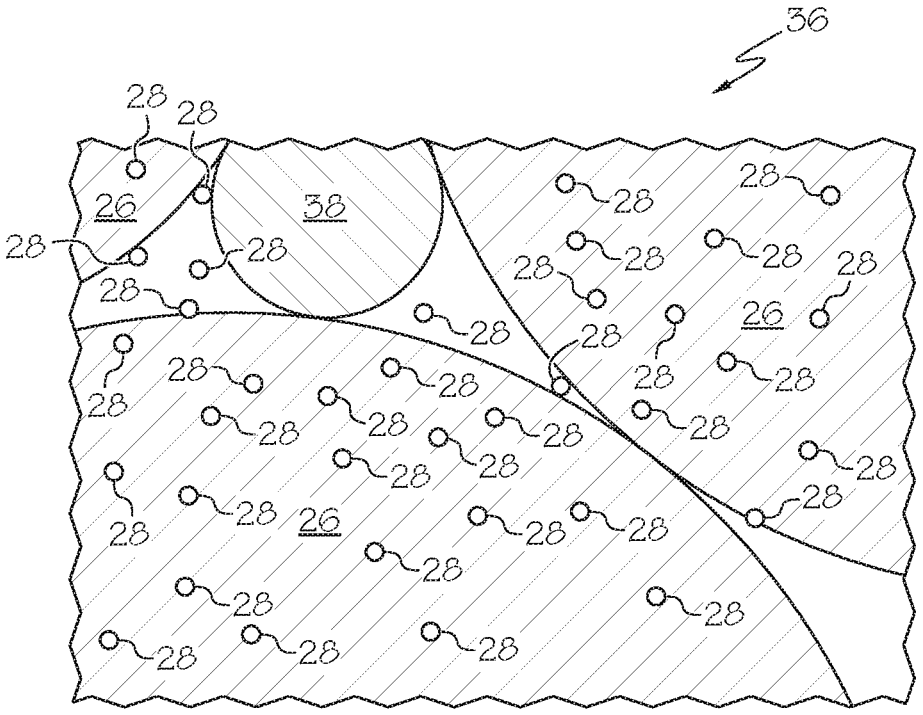

Preparation of the uniformly dispersed, particle-infiltrated powder mixture may conclude after STEP 32 (FIG. 1). Alternatively, the above-described process may be repeated, as appropriate, to introduce additional the ceramic particles into the final powder mixture, whether the additional particles are of the same type or a different type than those initially included in the powder mixture. If desired, one or more additives can also be mixed into the uniformly dispersed powder mixture to further refine the properties of the high temperature articles formed therefrom (STEP 34, FIG. 1). For example, in embodiments wherein it is desired that the high temperature article having an even greater hardness than that provided by the particle-infiltrated superalloy mother particles alone, additional hard wear particles may be introduced utilizing a mixing process similar to that described above in conjunction with STEP 22 of exemplary method 20 (FIG. 1). Such hard wear particles may have an average diameter greater than that of the ceramic particles and less than that of the superalloy mother particles; e.g., in one embodiment, carbide particles having an average diameter between about 0.5 and 5 μm may be added to the uniformly dispersed powder mixture utilizing, for example, a RAM process of the type described above. If added, the hard wear particles may comprise up to about 30 wt % of the final uniformly dispersed powder mixture in an embodiment. To further emphasize this point, FIG. 3 illustrates a magnified portion of a uniformly dispersed powder mixture 36 wherein ceramic particles 28 have been embedded throughout ceramic mother particles 26 and wherein intermediate-sized hard wear particles 38 (only one of which is shown in FIG. 3), such as carbide particles, have been added following the above-described ceramic particle infiltration process.

By virtue of the above-described process, a uniformly dispersed, particle-infiltrated powder mixture has now been produced. In some embodiments, the uniformly dispersed powder mixture may consist essentially of the superalloy powder and ceramic particles. In other embodiments, the uniformly dispersed powder mixture may contain other constituents in powder form, such as hard wear particles added after the above-described particle infiltration process. In some embodiments, the uniformly dispersed powder mixture may contain or consist essentially of at least 85 wt % superalloy powder and between 0.1 and 10 wt % of ceramic particles or nanoparticles. In other embodiments, the uniformly dispersed powder mixture may contain or consist essentially of at least 85 wt % superalloy powder and the remainder particulate ceramic materials, whether present solely in the form of nanoparticles or present in the form of both nanoparticles and larger particles, such as hard wear particles 38 shown in FIG. 3. The resulting powder mixture may be substantially free (that is, contain less than 0.01 wt %) of organic materials. While largely entrained within the superalloy mother particles, a relatively small amount of the ceramic particles may still remain external to the superalloy mother particles. In one embodiment, the process conditions are controlled such that the majority and, preferably, the substantial entirety (i.e., at least 95%) of the ceramic particles are embedded within the superalloy mother particles pursuant to STEP 34 of exemplary method 20.

Figure 4:
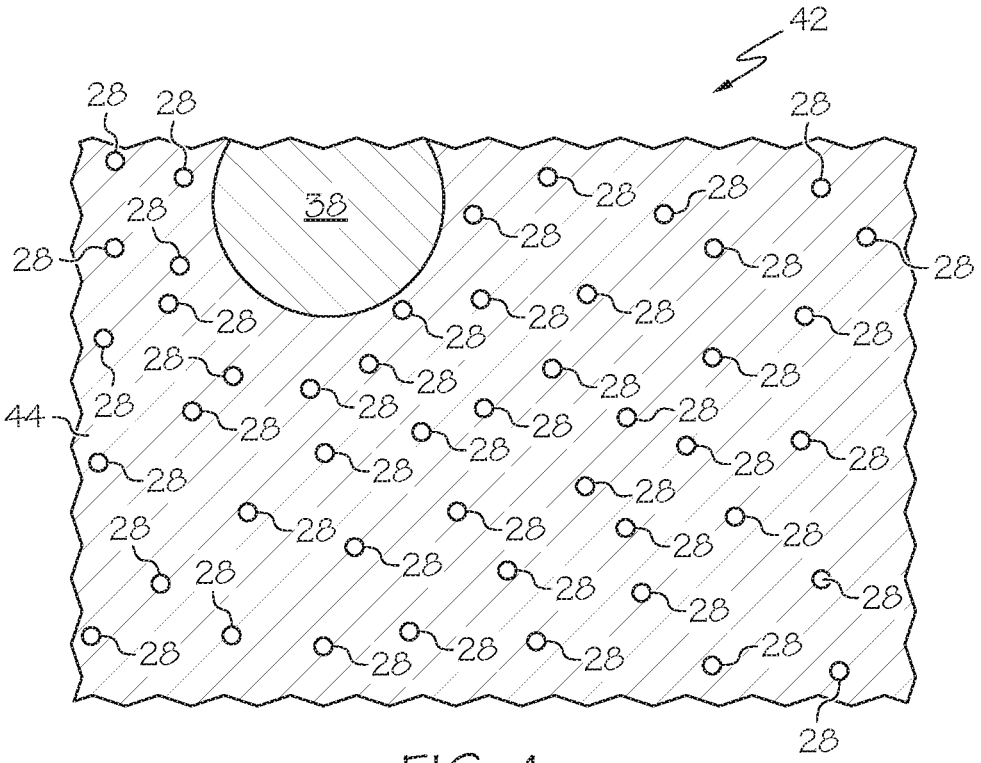
FIG. 4 is a cross-sectional view of a magnified region of an exemplary high temperature component or article that may be produced pursuant to the exemplary method illustrated in FIG. 1.

Referring once again to FIG. 1, exemplary method 20 concludes with the production of at least one high temperature article from the uniformly dispersed, particle-infiltrated powder mixture (STEP 40, FIG. 1). Conventional powder metallurgy techniques, such as sintering and hot isostatic pressing, may be employed to produce the high temperature article from the powder mixture. Generally, the uniformly dispersed powder mixture will be subject to temperature and pressure conditions sufficient to cause the sintering of the superalloy mother particles and the consequent formation of a superalloy matrix in which the ceramic particles are suspended along with any other non-metallic, non-organic constitutions included within the powder mixture. This may be more appreciated by referring to FIG. 4, which illustrates a magnified portion of an article 42 produced from the exemplary uniformly dispersed powder 36 shown in FIG. 3. As can be seen, article 42 is composed of superalloy matrix 44 in which the smaller ceramic particles 28 and the larger hard wear particles 38 are suspended. Additionally, it will be observed that ceramic particles 28 and hard wear particles 38 are relatively uniformly dispersed throughout matrix 44.

Figure 5:
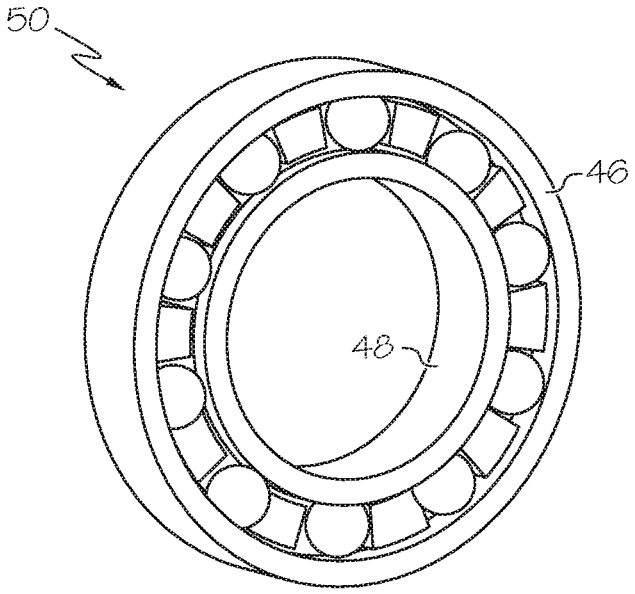
FIG. 5 is an isometric view of a ball bearing including inner and outer rings that may be produced pursuant to the exemplary method illustrated in FIG. 1 to impart the inner and outer rings with enhanced properties under high temperature operating conditions.

Various different high temperature articles or components may be produced from the uniformly dispersed powder mixture during STEP 40 (FIG. 1). For example, in embodiments wherein the powder mixture includes hardness-increasing ceramic particles, such as carbide nanoparticles, the uniformly dispersed powder mixture is advantageously utilized to produce high temperature components subject to abrasion, severe loading conditions, harsh vibratory conditions, or the like. For example, the powder mixture may be utilized to produce the inner ring 46 and/or the outer ring 48 of the exemplary ball bearing 50 shown in FIG. 5; or the inner ring or outer ring of another type of rolling element bearing. Similarly, the uniformly dispersed powder mixture may be utilized to produce high temperature bushings. In other embodiments wherein the powder mixture includes strength-enhancing ceramic particles, such as oxide nanoparticles, the uniformly dispersed powder mixture may be advantageously utilized in the production of high temperature components included within the hot section of a gas turbine engine and exposed to combustive gas flow during operation thereof. Such components may include, but are not limited to, turbine blades, vanes, nozzle rings, and the like.

The foregoing has thus provided embodiments of a method for producing superalloy powder mixtures suitable for usage in the production of articles or components having enhanced performance characteristics under high temperature operating conditions. The superalloy powder mixtures described herein include ceramic particles, such as ceramic nanoparticles, relatively uniformly dispersed throughout a superalloy powder including within the individual mother particles making-up the superalloy powder. In accordance with further embodiments of the method described herein, the superalloy powder mixture can be processed utilizing conventionally-known metallurgical techniques to produce high temperature articles composed of a superalloy matrix throughout which the smaller ceramic particle, such as ceramic nanoparticles, are distributed.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended claims.

What is claimed is:

1. A superalloy powder mixture, comprising:

a particle-infiltrated superalloy powder, comprising:

a plurality of superalloy mother particles; and ceramic particles embedded into the plurality of superalloy mother particles and having an average diameter less than an average diameter of the superalloy mother particles; and carbide particles mixed with the superalloy powder, the carbide particles having an average diameter greater than that of the ceramic particles and less than that of the superalloy mother particles.

2. The superalloy powder mixture of claim 1 wherein the carbide particles have an average diameter between 0.5 and 5.0 microns.

3. The superalloy powder mixture of claim 1 wherein the superalloy powder mixture contains at least 85% of the plurality of superalloy mother particles, by weight, with a remainder of the superalloy powder consisting essentially of the ceramic particles and the carbide particles.

4. The superalloy powder mixture of claim 1 wherein the ceramic particles comprise oxide particles.

5. The superalloy powder mixture of claim 4 wherein the oxide particles are selected from the group consisting of alumina particles and zirconia particles.

6. The superalloy powder mixture of claim 1 wherein the ceramic particles comprise non-oxide particles selected from the group consisting of carbide particles, boride particles, nitride particles, and silicide particles.

7. The superalloy powder mixture of claim 1 wherein the ceramic particles have an average diameter between about 10 and about 100 nanometers.

8. The superalloy powder mixture of claim 7 wherein the superalloy mother particles have an average diameter between about 5 and about 40 microns.

9. The superalloy powder mixture of claim 1 wherein the plurality of superalloy mother particles are selected from the group consisting of a plurality of nickel-based superalloy mother particles and a plurality of cobalt-based superalloy mother particles.

10. A superalloy powder mixture, consisting essentially of:

at least 85% superalloy mother particles, by weight; and the remainder ceramic particles, by weight;

wherein at least a majority of the ceramic particles are infiltrated into the superalloy mother particles, and wherein the ceramic particles comprise:

ceramic nanoparticles having an average diameter less than that of the superalloy mother particles; and carbide particles having an average diameter greater than that of the ceramic nanoparticles and less than that of the superalloy mother particles.

11. The superalloy powder mixture of claim 10 wherein a substantial entirety of the ceramic nanoparticles is embedded in the superalloy mother particles.

12. The superalloy powder mixture of claim 10 wherein the carbide particles have an average diameter between 0.5 and 5 microns, wherein the superalloy mother particles have an average diameter between about 5 and 40 microns, and wherein the ceramic nanoparticles have an average diameter between about 5 and about 500 nanometers.

13. A superalloy powder mixture, comprising:

a superalloy powder comprising a plurality of superalloy mother particles;

ceramic particles distributed throughout the superalloy powder and having an average diameter less than that of the superalloy mother particles, at least a majority of the ceramic particles embedded within the superalloy mother particles; and carbide particles mixed with the superalloy powder, the carbide particles having an average diameter greater than an average diameter of the ceramic particles and less than an average diameter of the superalloy mother particles.

14. The superalloy powder mixture of claim 13 wherein the superalloy powder mixture is substantially free of organic materials.

15. The superalloy powder mixture of claim 13 wherein the average diameter of the ceramic particles is less than 1/100 that of the average diameter of the superalloy mother particles.

16. The superalloy powder mixture of claim 13 wherein the carbide particles have an average diameter between about 0.5 and about 5.0 microns.

17. The superalloy power mixture of claim 13 wherein the ceramic particles comprise carbide nanoparticles.

18. The superalloy power mixture of claim 13 wherein the ceramic particles comprise oxide nanoparticles.

* * * * *